US006826376B2

(12) United States Patent
An et al.

(10) Patent No.: US 6,826,376 B2
(45) Date of Patent: Nov. 30, 2004

(54) IMAGE FORMING APPARATUS WHICH FACILITATES REDESIGN AND COMPONENT ARRANGEMENT METHOD THEREOF

(75) Inventors: Seung-deog An, Yongin (KR); Cheol-ju Yang, Daegu (KR); Sang-sin Park, Suwon (KR); Yoon-seop Eom, Suwon (KR); Yong-geun Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/623,795

(22) Filed: Jul. 22, 2003

(65) Prior Publication Data

US 2004/0096233 A1 May 20, 2004

(30) Foreign Application Priority Data

Jul. 22, 2002 (KR) ..... 2002-43017
Feb. 20, 2003 (KR) ..... 2003-10809
Jul. 21, 2003 (KR) ..... 2003-49666

(51) Int. Cl.[7] ..... G03G 15/00
(52) U.S. Cl. ..... 399/75; 399/90

(58) Field of Search ..... 399/1, 107, 75, 399/90

(56) References Cited

U.S. PATENT DOCUMENTS 6,377,764 B1 * 4/2002 Morris-jones ..... 399/75
6,477,345 B2 * 11/2002 Kimura et al. ..... 399/107

* cited by examiner

*Primary Examiner*—Hoang Ngo
(74) *Attorney, Agent, or Firm*—Staas & Halsey LLP

(57) ABSTRACT

An image forming apparatus is configured to facilitate design modification. The image forming apparatus has an engine mechanism to carry out a printing job with respect to a print data applied from an external device, an image processing unit to convert the print data into image data, and an engine controlling unit to control the engine mechanism to carry out the print job with respect to the image data. The engine controlling unit and the image processing unit are arranged on a single printed circuit board (PCB) in which a first and a second division are defined, with the engine controlling unit being arranged in the first division and the image processing unit being arranged in the second division. A circuit element in the second division is shared by the engine controlling unit and the image processing unit to reduce costs and redesign time.

27 Claims, 9 Drawing Sheets

IMAGE FORMING APPARATUS WHICH FACILITATES REDESIGN AND COMPONENT ARRANGEMENT METHOD THEREOF

CROSS-REFERENCE TO RELATED APPLICATIONS

This application claims the benefit of Korean Application No. 2002-43017, filed Jul. 22, 2002, Korean Application No. 2003-10809, filed Feb. 20, 2003, and Korean Application No. 2003-40666, filed Jul. 21, 2003, all filed in the Korean Intellectual Property Office, the disclosures of which are incorporated herein by reference.

BACKGROUND OF THE INVENTION

1. Field of the Invention

The present invention relates to an image forming apparatus, and more particularly to an image forming apparatus that is readily redesignable for purposes such as an addition of an improvement or a new function, and a component arrangement method of the same.

2. Description of the Related Art

Image forming apparatuses such as laser printers receive print data from an image processing apparatus such as a personal computer and reproduce the received print data on a printing medium such as a paper sheet. Recently, such image forming apparatuses have been incorporated into a multi-functioned machine such as a fax-copier image forming apparatus.

As the image forming apparatus technology rapidly advances, the molding and the printed circuit board (PCB) are requiring more frequent updating. However, the metal molding by nature requires a longer time than the PCB for a design process, and also requires a reliability test after the design is completed. Accordingly, there is usually a three to five year interval until the image forming apparatus is redesigned, and usually, it is the PCB which is the subject of the redesign.

Meanwhile, due to individual characteristics, the design for the metal mold and the PCB are usually planned by separate companies. Thus, the metal mold generally needs to be equipped with various motors to drive the image forming apparatus and a PCB to control the motors. Usually, the motor and the PCB for motor control are available as a set, and when used to design the image forming apparatus, because the PCB has a verified quality, a reliability test time may be reduced. In contrast, if one buys the metal mold and PCB separately and attempts to design an image forming apparatus using them, since the user is also required to prepare and install components such as a random access memory and Flash ROM (or mask ROM, or EPROM) to store programs to drive the processor, the user would require a significant amount of time to complete the design.

FIG. 1 is a block diagram of an example of a conventional laser printer. The laser printer includes an image processing unit 20, a switching mode power supply (SMPS) 30, an engine controlling unit 40, a high voltage power supply (HVPS) 50 and an engine mechanism 60.

The image processing unit 20 converts the print data received from a host computer 10 into image data such as bit map data which are processible at the engine controlling unit 40. The SMPS 30 generates power for driving the image processing unit 20, the engine controlling unit 40, the HVPS 50 and the engine mechanism 60. The engine controlling unit 40 controls the driving of the engine mechanism 60 in accordance with the image data applied from the image processing unit 20. The engine mechanism 60 is driven by the engine controlling unit 40 to reproduce an image on the printing medium such as a paper, and includes necessary mechanical devices such as a motor, a roller and an organic photoconductor (OPC). The engine controlling unit 40 includes a processor (not shown), a random access memory (not shown) and a Flash ROM (or mask ROM, or EEPROM; not shown) to drive the processor. The engine controlling unit 40 controls the operation of the mechanical devices such as a motor, a roller and an OPC in response to the image data.

FIGS. 2A and 2B are block diagrams of the image processing unit 20 and the engine controlling unit 40 of FIG. 1. First, the image processing unit 20 of FIG. 2A includes an interface unit 21 which receives the print data from the host computer 10, a central processing unit (CPU) 23 to control the overall operation of the image processing unit 20, a ROM 22 to store various control programs and application programs for driving the CPU 22, a random access memory (RAM) 24 to temporarily store data generated during the print data processing, and an EEPROM 25 for storing initial conditions or control set values of the image processing unit 20.

The engine controlling unit 40 shown in FIG. 2B includes a ROM 41 to load control programs for the turn-on or resetting of the engine controlling unit 20 on the CPU 42, a CPU 42 to control the overall operation of the engine controlling unit 40 according to the programs stored in the ROM 41, a random access memory (RAM) 43 to temporarily store the data generated by the program execution of the CPU 42, an EEPROM 44 to store set values for setting control data or the operational states of the engine mechanism 60, and an engine interface unit 45 to provide interface between the engine mechanism 60 and the CPU 42.

As described above, conventionally, the engine controlling unit 40 and the image processing unit 20 were formed on separate PCBs, each of which being equipped with the processor 23, 42, the ROM 22, 41, the random access memory 24, 43 and the EEPROM 25, 44. Accordingly, a separate interface (not shown) was required for the data transmission between the processors 23, 42 of the two separate PCBs. For example, for the processors 23, 42 to support different input/output interfaces, an interface circuit is inevitably required to convert two different data formats of the processors 23, 42. The requirement for the extra parts such as an interface circuit increases the unit price of the image forming apparatus, while degrading the data transmission speed between the processors 23, 43.

FIG. 3 is a schematic sectional view illustrating the engine mechanism 60 of FIG. 1. The engine mechanism 60 includes a photosensitive drum 61 having an electrically-chargeable layer to facilitate formation of an electric potential difference at the area charged by the exposure to the light of the light source, a laser scanning unit (LSU) 63 which converts the image data into optical signals, irradiates the optical signals onto the photosensitive drum 61 to form an electrostatic latent image by the electric potential difference, a developing unit 64 which sequentially supplies toners of respective colors onto the photosensitive drum 61, a transfer unit 65 which transfers the toner image from the photosensitive drum 61 onto a printing paper P, and a fusing unit 66 which fixes the transferred toner image on the printing paper P.

The developing unit 64 includes four toner reservoirs 64*a*~64*d* that sequentially feed toners of respective colors such as yellow Y, magenta M, cyan C and black B to develop the image on the photosensitive drum 61. The reference numeral 64*e* denotes a developing roller which applies yellow color toner onto the photosensitive drum 61. Although not shown, the developing roller is also provided to the other toner reservoirs 64*b*~64*d*.

The transfer unit 65 includes a transfer belt 65*a* that serves as a transfer medium for the toner image of the photosensitive drum 61, a first transfer roller 65*b* which transfers the toner image of the photosensitive drum 61 onto the transfer belt 65*a*, and a second transfer roller 65*c* which transfers the toner image of the transfer belt 65*a* onto the printing paper P.

The image forming apparatus, constructed as above, forms a desired electrostatic latent image on the photosensitive drum 61 as the laser beam is irradiated from the LSU 63 onto certain areas of the photosensitive drum 61 that is charged to a predetermined potential by the charging unit 62.

Next, the electrostatic latent image is developed by the developing unit 64, in which usually the yellow Y, magenta M, cyan C and black B toners of the toner reservoirs 64*a*~64*d* are sequentially fed onto the photosensitive drum 61 by the rotation of the developing unit 64.

Each color toner image, which has been developed on the photosensitive drum 61 by the developing process above, is overlappingly transferred onto the transfer belt 65*a*, and the image formed on the transfer belt 65*a* by the color toner images is then transferred onto the printing paper P, wherein the image is transferred from the transfer belt 65*a* using the second transfer roller 65*c*.

The printing paper P bearing the image thereon is passed through the fusing unit 66, where the image is fixed on the printing paper P. Then the printing paper P is discharged.

FIG. 4 shows the arrangement of the harness in the image forming apparatus including the image processing unit 20, the engine controlling unit 40 and the engine unit 60 of FIGS. 1 to 3. As shown in FIG. 4, a harness guide 70 is arranged along the boundary of the PCBs 20*a*, 40*a* of the image processing unit 20 and the engine controlling unit 40 to protect the electric lines and signal lines for the components of the engine mechanism 60, i.e., the photosensitive drum 61, the charging unit 62, the LSU 63, the developing unit 64, the transfer, unit 65 and the fusing unit 66. The PCBs 20*a*, 40*a* are respectively designed and arranged for the image processing unit 20 and the engine controlling unit 40, for the convenience of upgrading and designing. Each of the PCBs 20*a*, 40*a* is equipped with a central processing unit (CPU), a random access memory (RAM) and a read only memory (ROM).

As described above, the image processing unit 20 and the engine controlling unit 40 are formed on the separate PCBs 20*a*, 40*a*, each with the CPU, RAM, ROM and EEPROM. By this structure, when there is a need to add or upgrade a certain function such as a resolution/printing speed increase or a copy/fax function, adding the function to the image forming apparatus such as a laser printer is non-complex because only the PCB mounted with the image processing unit 20 may be replaced. However, in order to add or upgrade a function, because the image processing unit 20 and the engine controlling unit 40 need to be re-mounted on the separate PCBs, each having the CPU, RAM and ROM, the manufacturing cost of the image forming apparatus increases. Further, in the case of upgrading the engine controlling unit 40, the image processing unit 20 is accordingly upgraded because the image processing unit 20 interfaces with the engine controlling unit 40. Accordingly, after the redesign is completed, both the engine controlling unit 40 and the image processing unit 20 have to undergo a reliability test on the PCBs 20*a*, 40*a* thereof, and then additionally through the EMI tests. As a result, the redesign process and the costs increase. Further, each of the engine controlling unit 40 and the image processing unit 20 have independent processors 42, 23, which are required to be connected through a separate interface circuit (not shown). Of course, a low-speed serial bus may be utilized for the simple information exchange such as a simple control command or status information. However, the control signals from the image processing unit 20 to the printing engine unit have to be transmitted at high speed. Thus, for the color image forming apparatus, a high transmission speed of the printing control data and printing data facilitates efficient printing.

SUMMARY OF THE INVENTION

Additional aspects and/or advantages of the invention will be set forth in part in the description which follows and, in part, will be obvious from the description, or may be learned by practice of the invention.

Accordingly, it is an aspect of the present invention to provide a PCT design method to reduce time and cost for the redesign of an image forming apparatus when there is need to improve printing performance or add a new function, and an image forming apparatus thereof.

It is another aspect of the present invention to provide an image forming apparatus to increase data transmission speed between the engine controlling unit and the image processing unit, and a method to mount the image forming apparatus on the PCB.

To achieve the above aspects and/or other features in an embodiment of the present invention, an image forming apparatus includes an engine mechanism to carry out a printing job with respect to a print data, an image processing unit to convert the print data into image data recognizable by the engine mechanism, and an engine controlling unit to control the engine mechanism to carry out the print job with respect to the image data. The engine controlling unit and the image processing unit are arranged on a single printed circuit board (PCB) in which a first division and a second division are defined, with the engine controlling unit being arranged in the first division and the image processing unit being arranged in the second division, wherein a circuit element in the second division is shared by the engine controlling unit and the image processing unit.

In an aspect, the image processing unit and the engine controlling unit are connected via a bidirectional parallel bus.

In another aspect, the image processing unit has a single processor, and the engine controlling unit is driven by the control of the single processor.

In an aspect, the engine controlling unit is configured as an application specific integrated circuit (ASIC).

In another aspect, the processor and the ASIC are arranged to face each other.

In an aspect, the engine controlling unit comprises at least one connector to interface with the engine mechanism, the connector being arranged to face a connection pin of the ASIC in a perpendicular and a horizontal relation.

In another aspect, the shared circuit element comprises at least one of a random access memory (RAM), a Flash read only memory (ROM) and a read only memory (ROM).

In an aspect, the engine controlling unit shares at least one of the RAM, the Flash ROM and the ROM with the image processing unit.

In another aspect, the image processing unit further comprises a connector to receive the print data, the connector being arranged to face a connection pin of the image processing unit in a perpendicular and a horizontal relation.

According to an embodiment of the present invention, an image forming apparatus includes an engine mechanism to carry out a print job with respect to a print data, an image processing unit to convert the print data into image data recognizable by the engine mechanism, and an engine controlling unit to control the engine mechanism to carry out the print job with respect to the image data. The image processing unit and the engine controlling unit are each configured as a processor and an application specific integrated circuit (ASIC), which are directly connected via a bidirectional bus.

In an aspect, the ASIC generates a control signal to drive the engine mechanism in response to the image data applied from the image processing unit.

In another aspect, the ASIC further comprises a memory to store status information of the engine mechanism.

In an aspect, the processor checks the status of the engine mechanism by reading the stored status information from the memory, and controlling the ASIC to transmit the image data to the engine controlling unit and carry out the print job.

In another aspect, the bidirectional bus comprises at least one an address bus, a data bus and a control bus, and configured as a parallel bus.

In an aspect, the processor and the ASIC are directly connected with each other via the bidirectional bus, and are arranged to face each other.

In another aspect, the image processing unit and the engine controlling unit are arranged on a single printed circuit board (PCB) which has more than one division defined thereon, and are directly connected with each other via the bidirectional bus.

In an aspect, the engine controlling unit comprises at least one connector to connect to the engine mechanism, and the connector is arranged to face a connection pin of the ASIC in a horizontal and a perpendicular relation.

According to an embodiment of the present invention, a PCB arrangement method of an image forming apparatus includes an arrangement of an engine mechanism to carry out a print job with respect to print data applied from an external device, an image processing unit to convert the print data from the external device into image data format, and an engine controlling unit to control the engine mechanism to carry out the print job with respect to the image data. The PCB arrangement method arranges the image forming apparatus on a single PCB, and includes the operations of defining the PCB into a first and a second division, and arranging the image process in the first division and the engine controlling unit in the second division, in a manner that the image processing unit and the engine controlling unit share a circuit element which is arranged in the first division.

In an aspect, the operation of arrangement in the first division further comprises the operation of installing a connector in the first division to interface with the engine mechanism.

In another aspect, the connector is arranged in at least a part of a boundary of the PCB corresponding to the first division.

In an aspect, the shared circuit element comprises at least one of a random access memory (RAM), a Flash read only memory (ROM) and a read only memory (ROM).

In another aspect, the engine controlling unit shares at least one of the RAM, the Flash ROM and the ROM with the image processing unit.

In an aspect, The image processing unit is arranged in the second division and has a connector to interface with the external device, the connector being arranged to face the image processing unit.

Additionally, according to an embodiment of the present invention, a PCB arrangement method of an image forming apparatus includes an arrangement of an engine mechanism to carry out a print job with respect to print data applied from an external device, an image processing unit to convert the print data from the external device into image data format, and an engine controlling unit to control the engine mechanism to carry out the print job with respect to the image data. The PCB arrangement method according to an embodiment of the present invention includes the operations of arranging the image processing unit and the engine controlling unit on a single PCB, and connecting the image processing unit and the engine controlling unit on the single PCB via a bidirectional parallel bus.

In an aspect, the image processing unit is configured as a processor and the engine controlling unit is configured as an application specific integrated circuit (ASIC).

In another aspect, the image processing unit and the engine controlling unit are arranged to face each other.

In an aspect, the method further includes the operation of installing a connector to a side of the single PCB to interface between the engine controlling unit and the engine mechanism.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
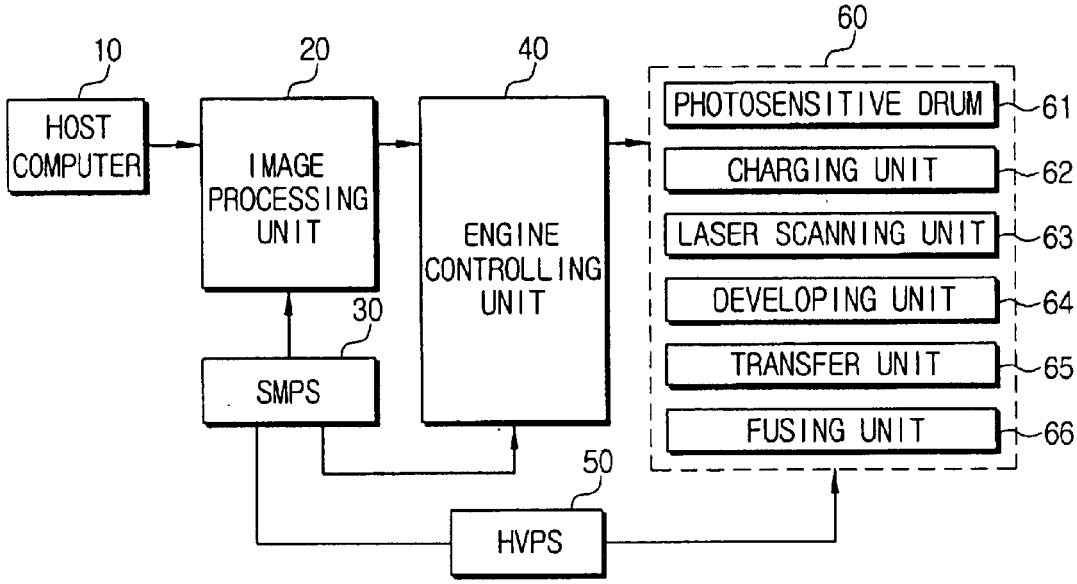
FIG. 1 (PRIOR ART)
FIG. 1 is a block diagram of a conventional laser printer.
Figure 2A:
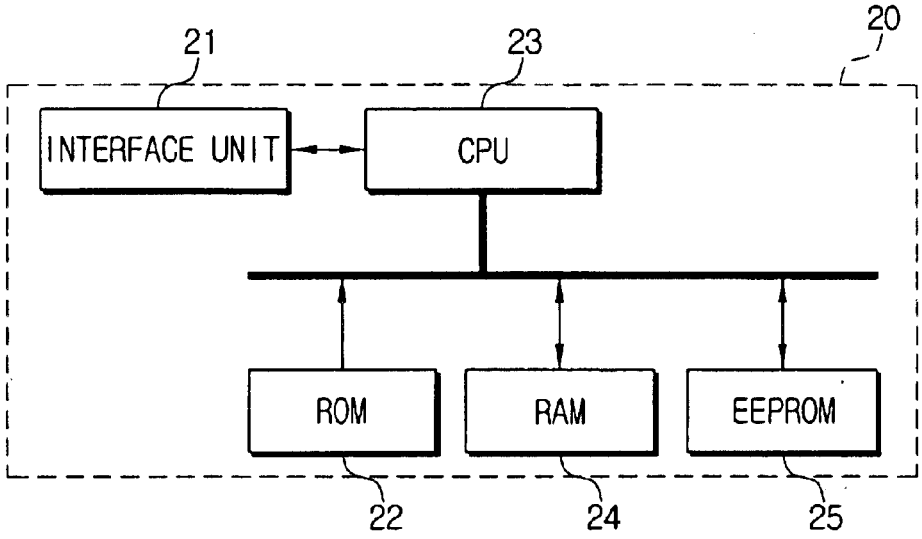
FIG. 2A (PRIOR ART)
FIGS. 2A and 2B are block diagrams of the interior of the image processing unit and the engine controlling unit of FIG. 1.
Figure 2B:
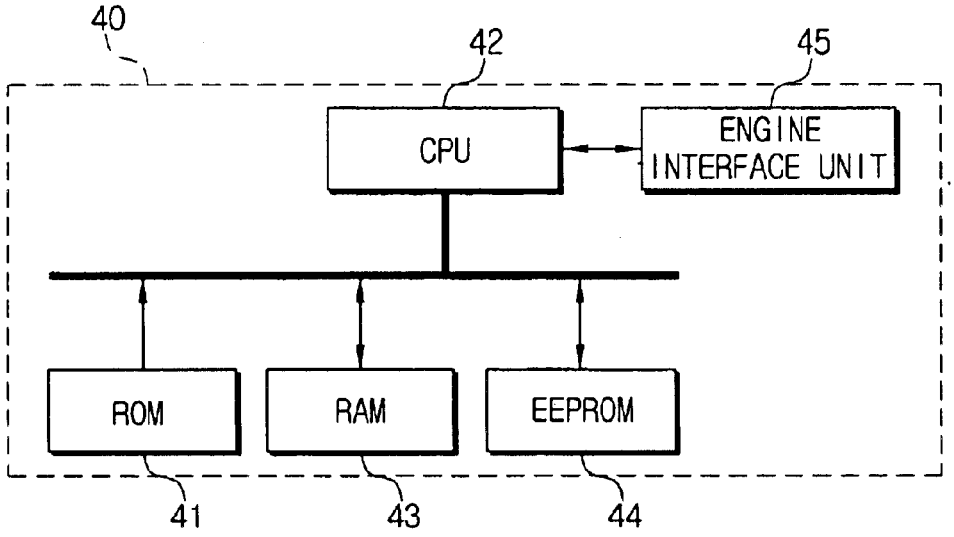
FIG. 2B (PRIOR ART)
Figure 3:
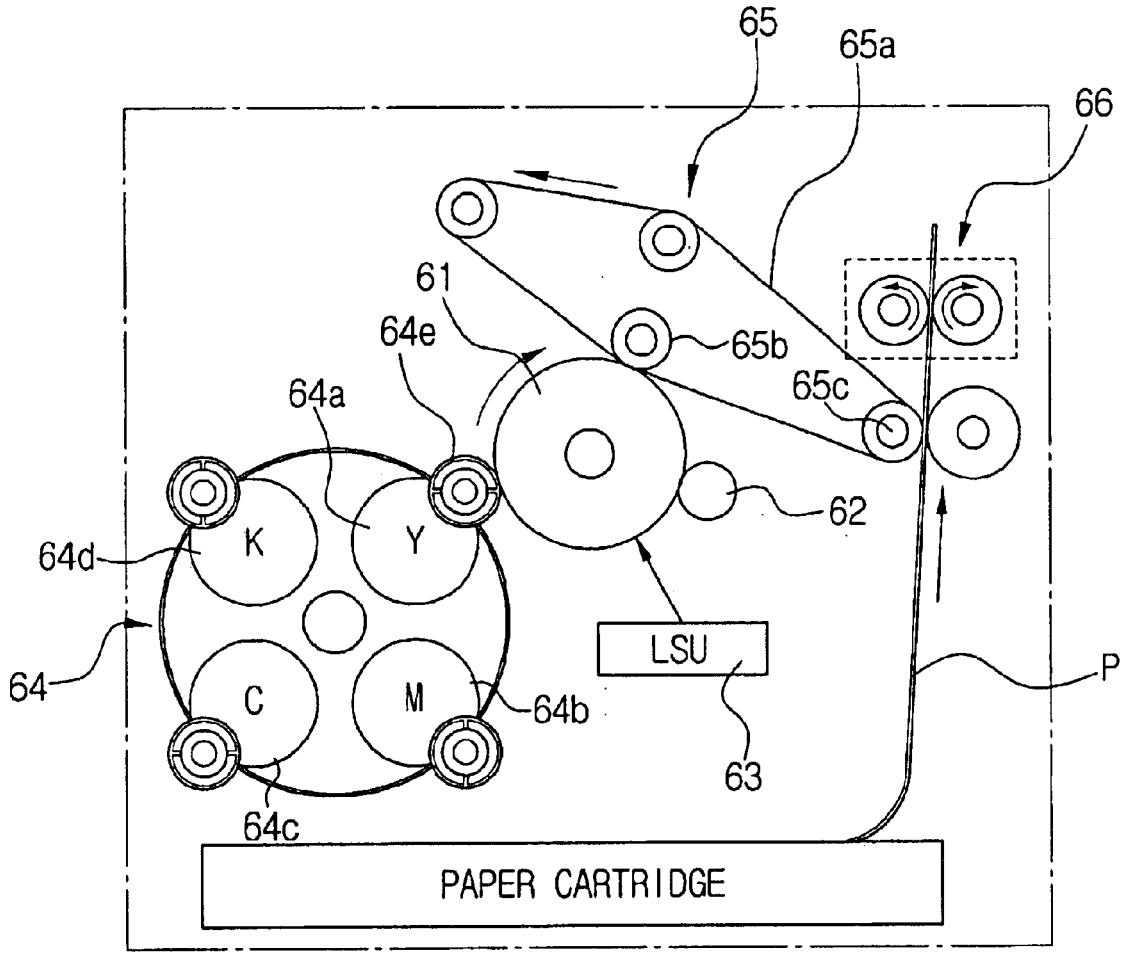
FIG. 3 (PRIOR ART)
FIG. 3 is a sectional view illustrating the engine mechanism of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 5:
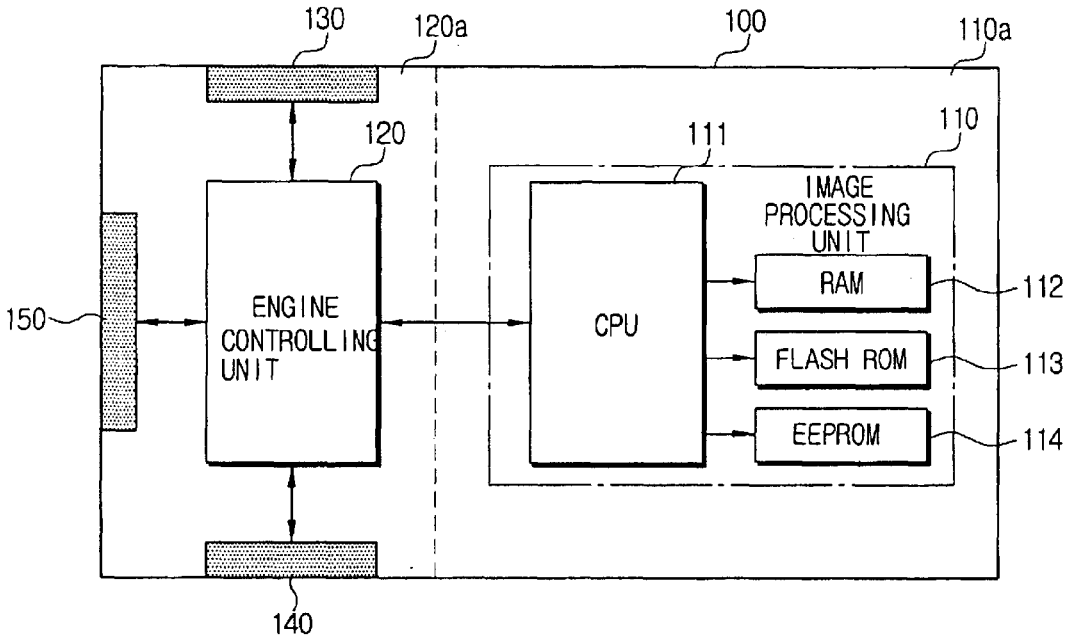
FIG. 5 is a view illustrating an embodiment of the present invention.

Referring to FIG. 5, an image forming apparatus 100 according to an embodiment of the present invention includes an image processing unit 110 which receives print data from an image processing apparatus such as a host computer (not shown) and converts the received print data into bitmap image data, and an engine controlling unit 120 controlled by the image data from the image processing unit 110 to control the engine mechanism (not shown) to represent a predetermined image on a printing medium such as a paper sheet. When the image processing unit 110 and the engine controlling unit 120 are mounted on a single printed circuit board (PCB) 100, the single PCB 100 is divided into two divisions 110*a*, 120*a* in accordance with the requirement area for the image processing unit 110 and the engine controlling unit 120. Along the boundary of the first area 120*a* where the engine controlling unit 120 is arranged, connectors 130, 140, 150 are arranged for the data transmission/reception between the engine controlling unit 120 and the engine mechanism (not shown). The engine controlling unit 120 is configured as an application specific integrated circuit (ASIC) to control mechanical components such as a motor, a roller and an organic photoconductor (OPC), with an input/output connecting pin thereof facing the connectors 130, 140, 150 at the boundary area. Because the input/output connecting pin (not shown) of the engine controlling unit 120 is connected with the connectors 130, 140, 150 at the shortest distance, robustness against external noise is obtained. Also, the engine controlling unit 120 and the image processing unit 110 may be configured to face each other to minimize the influence from the external noise as much as possible. Here, by configuring the engine controlling unit 120 as the ASIC, there is no need to provide a separate interface circuit between the processor 111 of the image processing unit 110 and the engine controlling unit 120, and the engine controlling unit 120 and the processor 111 may be connected with each other by the bi-directional parallel bus to increase data transmission rate per time unit, and reduce space requirements and material costs for the separate interface circuit.

By configuring the engine controlling unit 120 as the ASIC, the engine controlling unit 120 does not need components such as a separate processor, RAM and Flash-ROM (or mask ROM, EPROM) to store various programs for driving the processor, because the engine controlling unit 120 as ASIC may share such components provided to the image processing unit 110.

Meanwhile, the image processing unit 110 includes a central processing unit 111, a random access memory (RAM) 112, a Flash read only memory (ROM) 113 and an EEPROM 114, among which the components, excluding the CPU 111, i.e., the RAM 112, the Flash ROM 113, and the EEPROM, are shared with the engine controlling unit 120 as the ASIC. In other words, the engine controlling unit 120 has a minimum required number of circuit elements for the direct control of the mechanical device such as the motor, the roller and the OPC, while sharing other components such as the RAM 112, the Flash ROM 113 and the EEPROM 114 with the image processing unit 110. For example, to improve the image representing ability of the image processing unit 110, there is no need to modify the design of the engine controlling unit 120, but modifying the design of the image processing unit 110 would be sufficient. Because there is no need to conduct reliability tests such as an EMI test on the engine controlling unit 120, time and costs for redesign of the image forming apparatus are reduced. Further, because the engine controlling unit 120 shares the components such as the RAM 112, the Flash ROM 113 and the EEPROM 114 with the image processing unit 110, the number of parts for the image forming apparatus can also be reduced.

Figure 6:
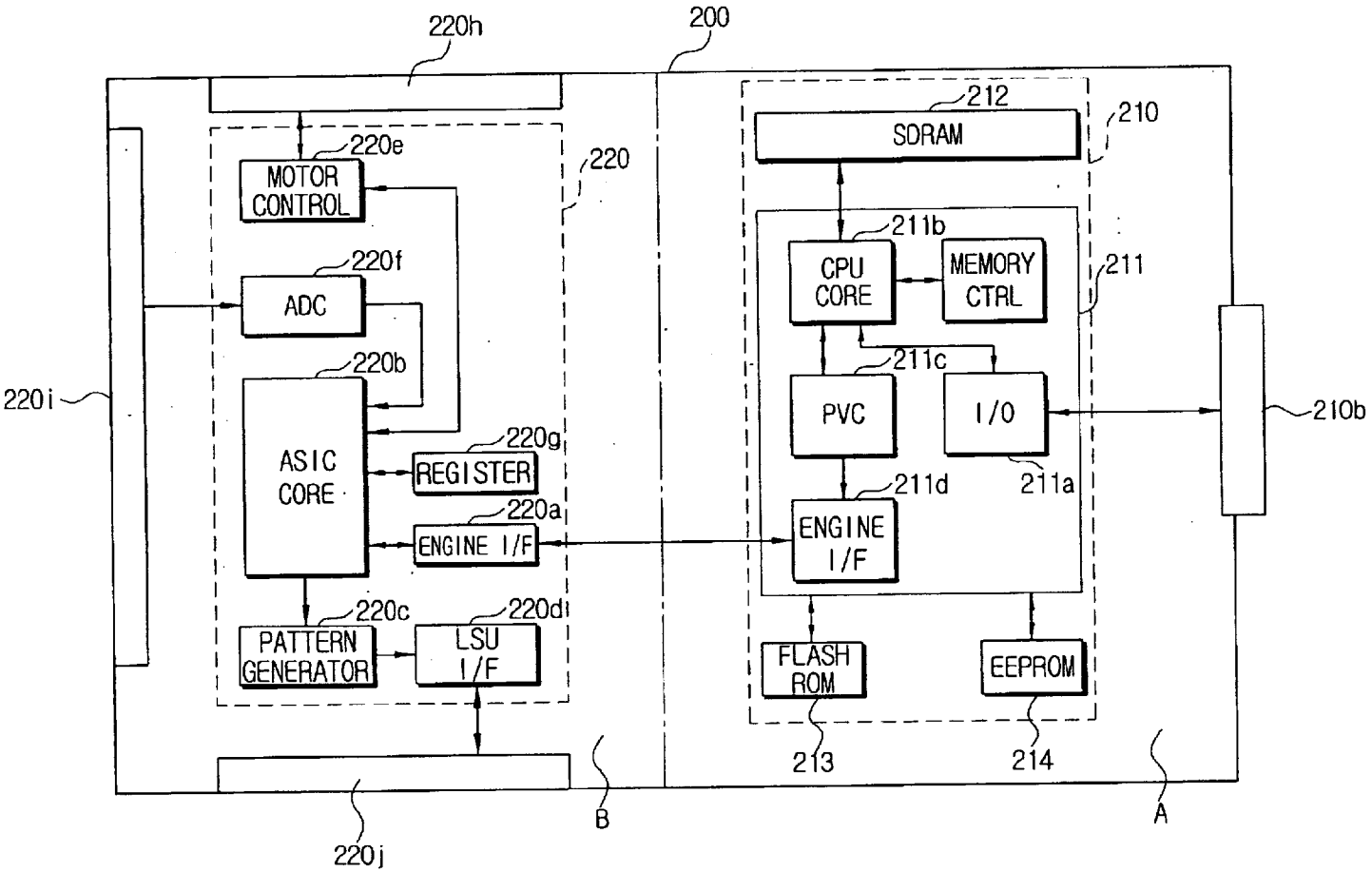
FIG. 6 is a view illustrating the arrangement of the PCB for the image processing unit and the engine controlling unit of FIG. 5.

FIG. 6 shows a preferred PCB arrangement for the image processing unit 110 and the engine controlling unit 120 of FIG. 5. As shown, the PCB arrangement of the image forming apparatus according to an embodiment of the present invention arranges the image processing unit 210 in the A-division, while arranging the engine controlling unit 220 in the B-division. As described above, the image processing unit 210 in the A-division receives print data from the image processing apparatus such as a personal computer (not shown), and converts the received data into bitmap image data, and the engine controlling unit 220 in the B-division controls the engine mechanism to represent a predetermined image on the printing medium, such as a paper, in response to the image data output from the image processing unit 210.

The image processing unit 210 includes a processor 211, a random access memory (RAM) 212, a Flash read only memory (ROM) 213 and an EEPROM 214. The processor 211 includes an input/output controller 211*a*, a CPU core 211*b*, an image data generator (PVC) 211*c* and an engine interface 211*d*.

The image processing unit 210 receives print data from the image processing apparatus such as a personal computer, through the parallel printer port such as an IEEE1284 port and the input/output controller 211*a*, and the CPU core 211*b* transmits the received data to the image data generator (PVC) 211*c* to generate image data in the same format as the bitmap.

In the above process, the image data generator (PVC) 211*c* requires a predetermined memory space for the image processing, and generates temporary data in the RAM 212 via the CPU core 211*b*. Then after final processing, the temporary data are output to the engine interface 211*d* via the image data generator (PVC) 211*c*. Data routing for the image processing data is performed by the CPU core 211*b* in accordance with the control programs stored in the Flash ROM 213.

The EEPROM 214 stores therein the initial condition values or control values of the image processing unit 210, and the set values to set the control data or operational status of the engine controlling unit 220. That is, the EEPROM 214 stores all the initial values and set values required by the image processing unit 210 and the engine controlling unit 220.

The engine controlling unit 220 is configured as an application specific integrated circuit (ASIC). The ASIC includes an engine interface 220*a*, an ASIC core 220*b*, a pattern generator 220*c*, a laser scanning unit (LSU) 220*d*, a motor controller 220*e*, and an analogue-digital converter (ADC) 211*f*.

Figure 4:
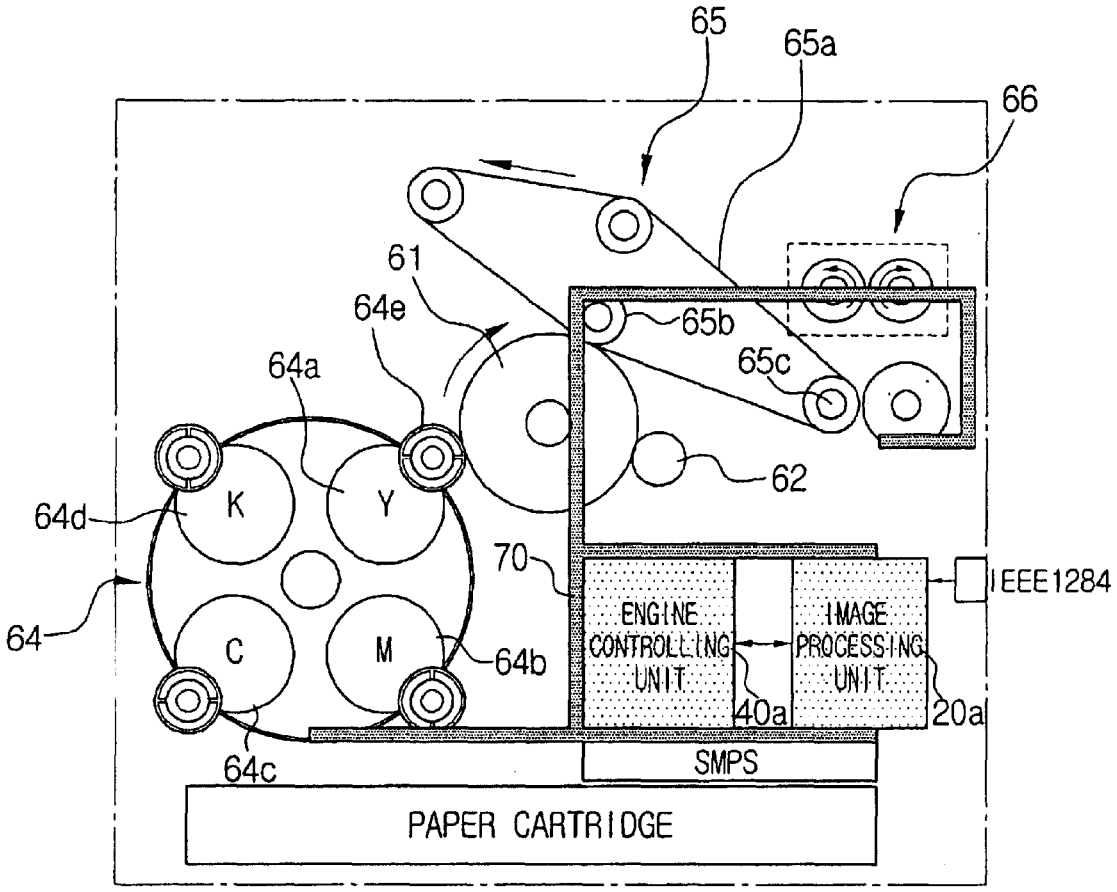
FIG. 4 (PRIOR ART)
FIG. 4 is a view illustrating an arrangement of the harness of the image forming apparatus having the image processing unit, the engine controlling unit and the engine mechanism of FIGS. 1 to 3.

The engine controlling unit 220 receives the image data from the engine interface 211*d* of the image processing unit 210 through the engine interface 220*a* thereof, and interprets the received data at the ASIC core 220*b*. According to the interpretation at the ASIC core 220*b*, the pattern generator 220*c* generates a pattern of the image to be generated by the engine mechanism (not shown) and drives the LSU 220*d* based on the generated pattern. Accordingly, the LSU 220*d* forms an electrostatic latent image on the photosensitive drum according to the result of the pattern generator 220*c* (FIG. 4).

The motor controller 220*e* controls the motor of the image forming apparatus according to the interpretation at the ASIC core 220*b*. An analog sensor (not shown) may be provided to the engine mechanism to monitor the operation of the motor, and the data from the analog sensor (not shown) is detected by the ADC 211*f* and feedback to the ASIC core 220*b*. The feedback sensed data is delivered via the ASIC core 220*b* and is stored in a register 220*g*. Such stored sensed data are applied to the processor 211 by the ASIC core 220*b* in response to the call of the processor 211.

Meanwhile, the engine controlling unit 220, configured as the ASIC, is arranged to face the connectors 220*h*, 220*i*, 220*j* at the boundary of the PCB. For example, the motor controller 220*e* may be connected with the connector 220*h* in a perpendicular relation, the ADC 220*f* in a horizontal relation with the connector 220*i*, and the LSU 220*d* in a perpendicular relation with the connector 220*j*. In other words, the connector of the interface between the engine controlling unit 220 and the engine mechanism is arranged to face the input/output connecting terminal of the ASIC-configured controller 220 in a perpendicular and a horizontal relation. As a result, the engine controlling unit 220 is connectible to the connectors 220*h*, 220*i*, 220*j* within the shortest distance possible. To modify the design of the image processing unit 210 for the purposes such as improvement in printing resolution and speed, such purpose may be sufficiently achieved by modifying only the design of the image processing unit 210. That is, there is no need to change the design of the engine controlling unit 220 because the engine controlling unit 220 has the function of controlling the engine mechanism. As the engine controlling unit 220 has already verified its EMI characteristics, time and costs for the redesign of the image forming apparatus 220 may be greatly reduced. Further, because the engine controlling unit 220 shares the RAM 212, the Flash ROM 213 and the EEPROM 214 of the image processing unit 210, the PCB for the image forming apparatus according an embodiment of the present invention may be more compact and may require a lower cost.

Figure 7:
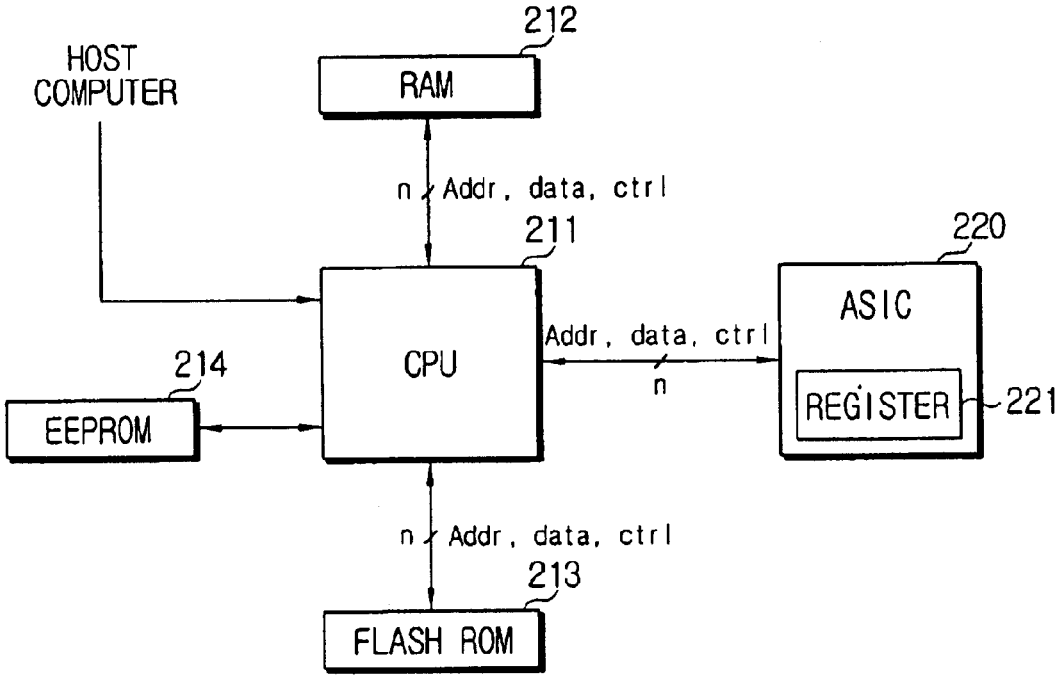
FIG. 7 is a view illustrating an embodiment the connection between the processor of FIG. 6 and the engine controlling unit formed as an ASIC.

FIG. 7 illustrates the connection between the CPU 211 of FIG. 6 and the engine controlling unit 220 configured as the ASIC. As shown, the CPU 211 is connected with the RAM 212, the Flash ROM 213 and the EEPROM 214 through a N-bit parallel bus, and also with the engine controlling unit 220 through the N-bit parallel bus. When the engine controlling unit 220 is configured as the ASIC, the engine controlling unit 220 is similar to a passive device which is controlled by the CPU 211. Accordingly, there is no need to place a separate interface circuit between the ASIC-configured controller 220 and the CPU 211. The CPU 211 and the ASIC-configured controller 220 are connected via a n-bit address bus (addr), data bus (data), and control bus (ctrl). The ASIC-configured controller 220 and the CPU 211 connected through the N-bit parallel bus have a very fast speed compared to a system using a separate interface circuit. Such a high speed of data transmission is especially important in the color image forming apparatus since there is a significant amount of print data for the image forming apparatus. The address bus (Addr) and the data bus (data) for the CPU 211 and the ASIC-configured controller 220 obtain status information from the register 221 of the engine controlling unit 220 about the engine mechanism. The register 221 responds to an address or a read command received at the engine ASIC-configured controller 220 from the CPU 221, and accordingly, the status information stored in the register 221 is fedback to the CPU 221 via the data bus (data).

Meanwhile, as the circuit elements, such as the CPU core 211b, the Flash ROM 213 and the EEPROM 214, are arranged in the A-division, the system diagnosis of the image forming apparatus according to the present invention may be conducted with convenience. Because the components to drive the engine mechanism, excluding the engine controlling unit 220, are arranged in the A-division where the image processing unit 210 is also arranged, almost all the errors, excluding the error related with the engine controlling unit 220, must be from the A-division. Further, because the engine controlling unit 220 is not equipped with the components such as the RAM 212, the Flash ROM 213 and the EEPROM 220, the system diagnosis takes far less time when compared to the conventional image forming apparatus in which a processor, a RAM and a Flash ROM are respectively provided to both the image processing unit 210 and the engine controlling unit 220.

Although an embodiment of the present invention has been described in the above-described embodiment employing the PCB having two divisions therein, the present invention may not be considered as limiting. For example, a PCB having no division at all may be used to embody the present invention. That is, the image processing unit 210 and the engine controlling unit 220 may be arranged on a PCB having no division, facing each other and connected via bidirectional parallel bus. With the PCB having no division, the advantageous characteristics of the present invention may still be obtained, such as a data transmission speed increase due to the bi-directional parallel connection between the image processing unit 210 and the engine controlling unit 220, a non-requirement for a separate interface circuit between the image processing unit 210 and the engine controlling unit 220, and shared use of RAM 212, Flash ROM 213 and EEPROM 214 between the image processing unit 210 and the engine controlling unit 220. The only difference is that the PCB with two divisions may provide still more advantages, which are mainly a requirement for a shorter time for the design modification of the image forming apparatus and the reliability test. These advantageous effects will not be described again, as the advantages have already been described in detail above with reference to FIGS. 5 and 6.

Figure 8:
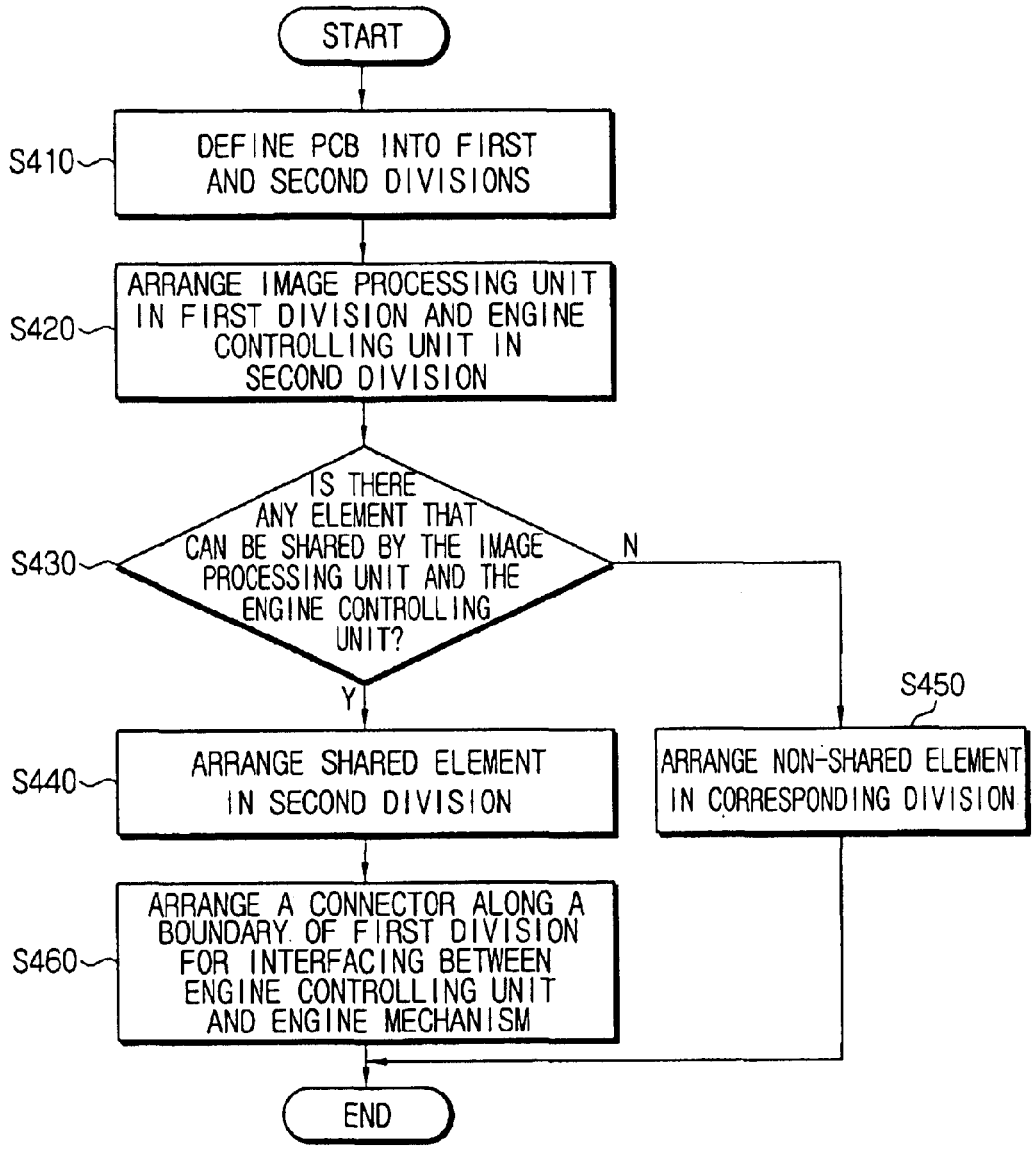
FIG. 8 is a flowchart illustrating a PCB arrangement method of the image forming apparatus according to an embodiment of the present invention.

FIG. 8 shows a PCB arrangement of the image forming apparatus according to an embodiment of the present invention. First, the image processing unit 210, that receives print data from the image processing apparatus such as a host computer (not shown) and converts the received print data into bitmap image data, and the engine controlling unit 220 controlled by the image data from the image processing unit 210, that controls the engine mechanism (not shown) to represent a predetermined image on a printing medium such as a paper, are arranged on the single PCB 200. More specifically, A and B divisions are defined on the PCB 200 (S410), and the image processing unit 110 is arranged in the A division, while the engine controlling unit 120 is arranged in the B division, respectively (S420).

Next, it is determined whether there is a circuit element that may be shared by the image processing unit 110 and the engine controlling unit 120 at the A and B divisions of the PCB 200 (S430). When it is determined that the RAM 212, Flash ROM 213 and the EEPROM 214 can be shared by the engine controlling unit 220 and the image processing unit 210, such elements are arranged in the A division where the image processing unit 210 is located (S440). As the engine controlling unit 220 may access the RAM 212, the Flash ROM 213 and the EEPROM 214 of the image processing unit 210 through the CPU 211, there is no need to provide the engine controlling unit 220 with the RAM 212, the Flash ROM 213 and the EEPROM 214. Accordingly, the engine controlling unit 220, which has already verified its reliability through the tests such as EMI test, is mostly likely to be used without requiring an additional update in design even during the redesign of the image forming apparatus. As a result, the cost and time for redesign of the image forming apparatus as a whole may be reduced.

The ASIC-configured engine controlling unit 220 is directly connected with the CPU 211 via the address bus (addr), the data bus (data) and the control bus (ctrl). Accordingly, there is no need to provide a separate interface circuit on the PCB to interface the engine controlling unit 220 and the CPU 211, the space of the PCB can be utilized more efficiently.

Next, the other elements that cannot be shared by the engine controlling unit 220 and the image processing unit 210 are arranged in the required divisions, respectively (S450). Finally, connectors, such as connectors 220*h*, 220*i*, 220*j*, are arranged in the B division to interface with the engine mechanism and the engine controlling unit 220, but along the boundary of the PCB, which is allotted to the B division (S460). The connectors may be arranged to face the input/output connection pin of the ASIC-configured engine controlling unit 220 in a perpendicular, or in a horizontal relation. In other words, the input/output connection pin of the ASIC is generally connected with the connector terminal (not shown) through a straight-line wiring. This way of wiring simplifies the metal wiring connecting the ASIC-configured engine controlling unit 220 and the connectors 220*h*, 220*i*, 220*j*, and thus provides advantages, such as easy diagnosis and repair in the event of error in the image forming apparatus, and also, the noise reduction in the metal wiring. For example, if the metal wiring connecting the ASIC-configured engine controlling unit 220 and the connectors 220*h*, 220*i*, 220*j* are at uniform intervals and patterns, by forming a ground plate opposite to the PCB side where the metal wiring is located, shield effect and robustness against external noise may be obtained.

Meanwhile, the image processing unit 210 is arranged in the A division, and more specifically, the image processing unit 210 in the form of a system on a chip (SOC) is arranged to face the ASIC-configured engine controlling unit 220. In other words, the pin direction of the engine controlling unit 220 is in a perpendicular, or a horizontal relation with the pin direction of the image processing unit 210, so that the image processing unit 210 and the engine controlling unit 220 may be connected with each other within a minimum distance as possible.

Figure 9:
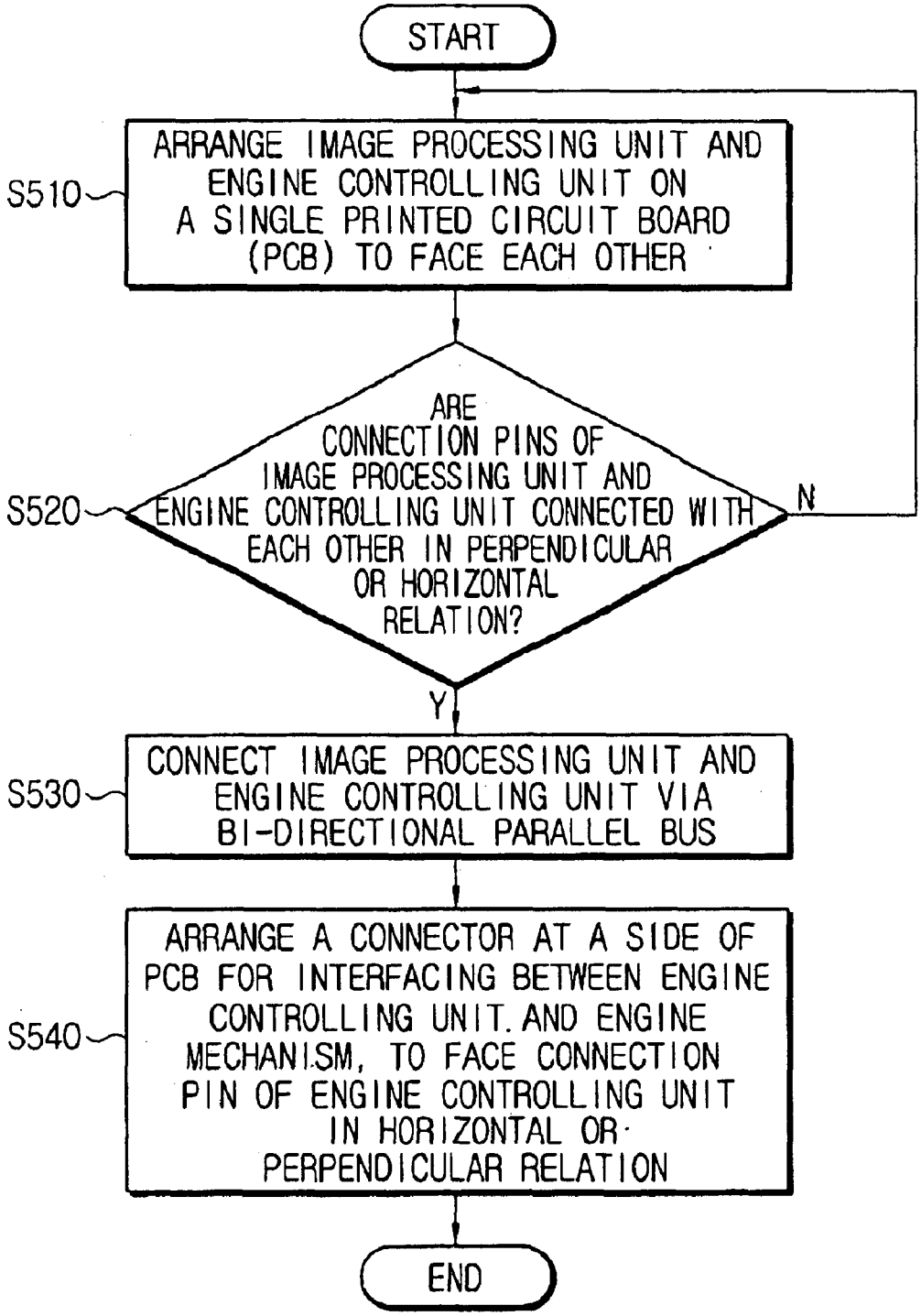
FIG. 9 is a flowchart illustrating a PCB arrangement method of the image forming apparatus according to another embodiment of the present invention.

FIG. 9 is a flowchart illustrating a PCB arrangement method for the image forming apparatus according to another preferred embodiment of the present invention. According to another embodiment, first, the image processing unit 210 and the engine controlling unit 220 are arranged on a single PCB, with the image processing unit 210 and the engine controlling unit 220 facing each other (S510). Next, it is determined whether a direct wiring of the input/output connection pins in perpendicular or a horizontal relation is possible between the image processing unit 210 and the engine controlling unit 220 (S520), and if so, the image processing unit 210 and the engine controlling unit 220 are connected via the bidirectional parallel bus (S530). The parallel bus includes an N-bit data bus (data), an address bus (addr) and a control bus (ctrl), and enables higher speed signal transmission compared to the conventional system. In the conventional way, the image processing unit 210 and the engine controlling unit 220 each required a separate processor, thus requiring an interface circuit therebetween. Also, a general serial protocol for the processor, such as RS232, was used in the conventional way. According to an embodiment of the present invention, by configuring the engine controlling unit 220 as the ASIC, there is no need for a separate interface circuit. Finally, connectors are arranged to face the input/output connection pins of the engine controlling unit 220 in a perpendicular or a horizontal relation to inteface between the engine mechanism and the engine controlling unit 220 (S540). Compared to the conventional system in which the engine controlling unit 220 and the image processing unit 210 are separately formed on the PCBs, the present invention may reduce the number of circuit elements. Also, according to the present invention, the engine controlling unit 220 and the image processing unit 210 are formed on a single PCB, and connected via a high-speed bi-directional parallel bus. The unique feature of the present invention does not simply lie in the fact that the requirement number of PCBs for the formation of the engine controlling unit 220 and the image processing unit 210 is reduced from two to one. Rather, by selecting the high-speed parallel bus on the single PCB, the present invention provides a more efficient design, which is more effective for the data amount increase between the engine controlling unit 220 and the image processing unit 220.

According to the present invention, the time and the costs for redesign of the engine controlling unit 220 and the image processing unit 210 of the image forming apparatus may be greatly reduced. Further, by configuring the engine controlling unit 220 to share the RAM, the Flash ROM and the EEPROM of the image processing unit 210, the unit price is decreased. Also, because the engine controlling unit 220 is configured to control the engine mechanism, generally the image processing unit 210 alone is newly designed for the upgrade or addition of a new function of the image forming apparatus. Furthermore, by arranging the image processing unit 210 and the engine controlling unit 220 on a single PCB and connecting such arranged image processing unit 210 and the engine controlling unit 220 through a bidirectional parallel bus, the system may efficiently process the possible increase of data amount between the engine controlling unit 220 and the image processing unit 210. Additionally, by simplifying the wiring among the engine controlling unit 220, the image processing unit 210 and the connectors, robustness against external or internal noise may be guaranteed.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

an engine mechanism to carry out a printing job with respect to a print data;

an image processing unit to convert the print data into image data recognizable by the engine mechanism;

an engine controlling unit to control the engine mechanism to carry out the print job with respect to the image data, and a circuit element, wherein the engine controlling unit and the image processing unit are arranged on a single printed circuit board (PCB) in which a first division and a second division are defined, with the engine controlling unit being arranged in the first division and the image processing unit being arranged in the second division, wherein the circuit element in the second division is shared by the engine controlling unit and the image processing unit.

2. The image forming apparatus of claim 1, wherein the image processing unit and the engine controlling unit are connected via a bidirectional parallel bus.

3. The image forming apparatus of claim 1, wherein the image processing unit has a single processor, and the engine controlling unit is driven by the control of the single processor.

4. The image forming apparatus of claim 3, wherein the engine controlling unit is configured as an application specific integrated circuit (ASIC).

5. The image forming apparatus of claim 4, wherein the processor and the ASIC are arranged to face each other.

6. The image forming apparatus of claim 5, wherein the engine controlling unit comprises at least one connector for an interfacing with the engine mechanism, the connector being arranged to face a connection pin of the ASIC in a perpendicular and a horizontal relation.

7. The image forming apparatus of claim 1, wherein the shared circuit element comprises at least one of a random access memory (RAM), a Flash read only memory (ROM) and a read only memory (ROM).

8. The image forming apparatus of claim 7, wherein the engine controlling unit shares at least one of the RAM, the Flash ROM and the ROM with the image processing unit.

9. The image forming apparatus of claim 1, wherein the image processing unit further comprises a connector to receive the print data, the connector being arranged to face a connection pin of the image processing unit in a perpendicular and a horizontal relation.

10. An image forming apparatus, comprising:

an engine mechanism to carry out a print job with respect to a print data;

an image processing unit to convert the print data into image data recognizable by the engine mechanism; and an engine controlling unit to control the engine mechanism to carry out the print job with respect to the image data, wherein the image processing unit and the engine controlling unit are each configured as a processor and an application specific integrated circuit (ASIC), which are directly connected via a bidirectional bus.

11. The image forming apparatus of claim 10, wherein the ASIC generates a control signal to drive the engine mechanism in response to the image data applied from the image processing unit.

12. The image forming apparatus of claim 10, wherein the ASIC further comprises a memory to store status information of the engine mechanism.

13. The image forming apparatus of claim 12, wherein the processor checks the status of the engine mechanism by reading the stored status information from the memory, and controlling the ASIC to transmit the image data to the engine controlling unit and carry out the print job.

14. The image forming apparatus of claim 10, wherein the bidirectional bus comprises at least one of an address bus, a data bus and a control bus, and is configured as a parallel bus.

15. The image forming apparatus of claim 14, wherein the processor and the ASIC are directly connected with each other via the bi-directional bus, and arranged to face each other.

16. The image forming apparatus of claim 10, wherein the image processing unit and the engine controlling unit are arranged on a single printed circuit board (PCB) which has more than one division defined thereon, and are directly connected with each other via the bi-directional bus.

17. The image forming apparatus of claim 10, wherein the engine controlling unit comprises at least one connector to connect to the engine mechanism, and the connector is arranged to face a connection pin of the ASIC in a horizontal and a perpendicular relation.

18. A PCB arrangement method of an image forming apparatus having an engine mechanism to carry out a print job with respect to print data applied from an external device, an image processing unit to convert the print data from the external device into image data format, an engine controlling unit to control the engine mechanism to carry out the print job with respect to the image data, and a circuit element, the PCB arrangement method arranging the image forming apparatus on a single PCB, comprising the operations of:

defining the PCB into a first division and a second division; and arranging the image process in the first division and the engine controlling unit in the second division, in a manner that the image processing unit and the engine controlling unit share the circuit element which is arranged in the first division.

19. The PCB arrangement method of claim 18, wherein the operation of arrangement in the first division further comprises the operation of installing a connector in the first division to interface with the engine mechanism.

20. The PCB arrangement method of claim 18, wherein the connector is arranged in at least a part of a boundary of the PCB corresponding to the first division.

21. The PCB arrangement method of claim 18, wherein the shared circuit element comprises at least one of a random access memory (RAM), a Flash read only memory (ROM) and a read only memory (ROM).

22. The PCB arrangement method of claim 18, wherein the engine controlling unit shares at least one of the RAM, the Flash ROM and the ROM with the image processing unit.

23. The PCB arrangement method of claim 18, wherein the image processing unit is arranged in the second division, and has a connector to interface with the external device, the connector being arranged to face the image processing unit.

24. A PCB arrangement method of an image forming apparatus having an engine mechanism to carry out a print job with respect to print data applied from an external device, an image processing unit to convert the print data from the external device into image data format, and an engine controlling unit to control the engine mechanism to carry out the print job with respect to the image data, the PCB arrangement method comprising the operations of:

arranging the image processing unit and the engine controlling unit on a single PCB; and connecting the image processing unit and the engine controlling unit on the single PCB via a bidirectional parallel bus.

25. The PCB arrangement method of claim 24, wherein the image processing unit is configured as a processor and the engine controlling unit is configured as an application specific integrated circuit (ASIC).

26. The PCB arrangement method of claim 24, wherein the image processing unit and the engine controlling unit are arranged to face each other.

27. The PCB arrangement method of claim 26, further comprising the operation of installing a connector to a side of the single PCB to interface between the engine controlling unit and the engine mechanism.

* * * * *

UNITED STATES PATENT AND TRADEMARK OFFICE

CERTIFICATE OF CORRECTION

PATENT NO. : 6,826,376 B2
DATED : November 30, 2004
INVENTOR(S) : Seung-deog An et al.

It is certified that error appears in the above-identified patent and that said Letters Patent is hereby corrected as shown below:

Title page,
Item [73], Assignee, change "Samsung Electronics Co., Ltd., Suwon (KR)" to -- Samsung Electronics Co., Ltd., Suwon-si (KR) --.

Column 12,
Line 70, change "bidirectional" to -- bi-directional --;

Column 13,
Lines 38 and 52, change "bidirectional" to -- bi-directional --;

Column 14,
Line 51, change "bidirectional" to -- bi-directional --.

Signed and Sealed this

Seventeenth Day of May, 2005

JON W. DUDAS
*Director of the United States Patent and Trademark Office*